US005476372A

United States Patent [19]

Yang

[11] Patent Number: 5,476,372

[45] Date of Patent: Dec. 19, 1995

[54] MANUAL PUMP

[76] Inventor: Hsi-Kung Yang, No. 24, Lane 65, San Chun St., Shu Lin Chen, Taipei Hsien, Taiwan

[21] Appl. No.: 194,692

[22] Filed: Feb. 10, 1994

[51] Int. Cl.[6] ..... F04B 39/10

[52] U.S. Cl. ..... 417/553

[58] Field of Search ..... 417/553, 552, 417/554

[56] References Cited

U.S. PATENT DOCUMENTS

| | | | |
|---|---|---|---|
| 1,108,903 | 9/1914 | Hancock | 417/553 X |
| 1,447,964 | 3/1923 | Coleman | 417/553 |
| 2,985,359 | 5/1961 | Hanje | 417/553 X |

FOREIGN PATENT DOCUMENTS

| | | | |
|---|---|---|---|
| 1327024 | 8/1973 | United Kingdom | 417/553 |

*Primary Examiner*—Richard E. Gluck
*Attorney, Agent, or Firm*—Kirkpatrick & Lockhart

[57] ABSTRACT

A manual pump which has a plunger and a cylinder. The cylinder defines a nozzle through a first end and an opening through a second end. A groove is circumferentially defined in an internal surface of the cylinder near the opening. Two slots are defined in a stem. The plunger has a stem and a piston which is formed at the first end of the stem. A knob is formed at the second end of the stem. The piston has first and second disks spaced from each other. A plurality of holes are defined through the first disk of the piston. A sealing ring is mounted between the first and second disks of the piston. An annular limit consists of two semi-annular halves between which the stem is inserted. Each semi-annular half has a semi-annular flange formed thereon in order to be engaged in the groove defined in the cylinder so that the annular limit is attached in the cylinder so as to retain the piston in the cylinder. A tab projects from the underside of each semi-annular half of the annular limit.

4 Claims, 5 Drawing Sheets

MANUAL PUMP

BACKGROUND OF INVENTION

The present invention relates to a manual pump.

There have been various manual pumps for inflating balls or tires. A conventional type of manual pump has a cylinder, a limit, a plunger consisting of a piston, a stem and a handle, a sealing ring mounted on the piston and a spring mounted about the stem and between the piston and the limit. However, it is found that the assembly of such a pump is cumbersome and inefficient. Moreover, the spring, which acts as a buffer to prevent the limit from becoming dislodged from the cylinder, is found to lose its resilience after being repeatedly subjected to impact.

SUMMARY OF INVENTION

It is a first object of the present invention to provide a manual pump which can be easily assembled.

The first object of the present invention is achieved by providing a manual pump which has a plunger and a cylinder. The cylinder has a first end defining a nozzle and a second end defining an opening. A groove is circumferentially defined in an internal surface of the cylinder near the opening. Two slots are defined in a stem. The plunger has a stem and a piston which is formed at the first end of the stem. A knob is formed at the second end of the stem. The piston has first and second disks spaced from each other. A plurality of holes are defined through the first disk of the piston. A sealing ring is mounted between the first and second disks of the piston. An annular limit consists of two semi-annular halves between which the stem is inserted. Each semi-annular half has a semi-annular flange formed thereon in order to be engaged in the groove defined in the cylinder so that the annular limit is attached in the cylinder so as to retain the piston in the cylinder.

It is another object of the present invention to provide a buffer between the piston and the limit of above-mentioned manual pump.

The second object of the present invention is achieved by providing a tab which projects from the underside of each semi-annular half of the annular limit.

For a better understanding of the present invention and objects thereof, a study of the detailed description of the embodiments described hereinafter should be made in relation to the accompanying drawings.

DESCRIPTION OF BACKGROUND OF THE INVENTION

Figure 5:
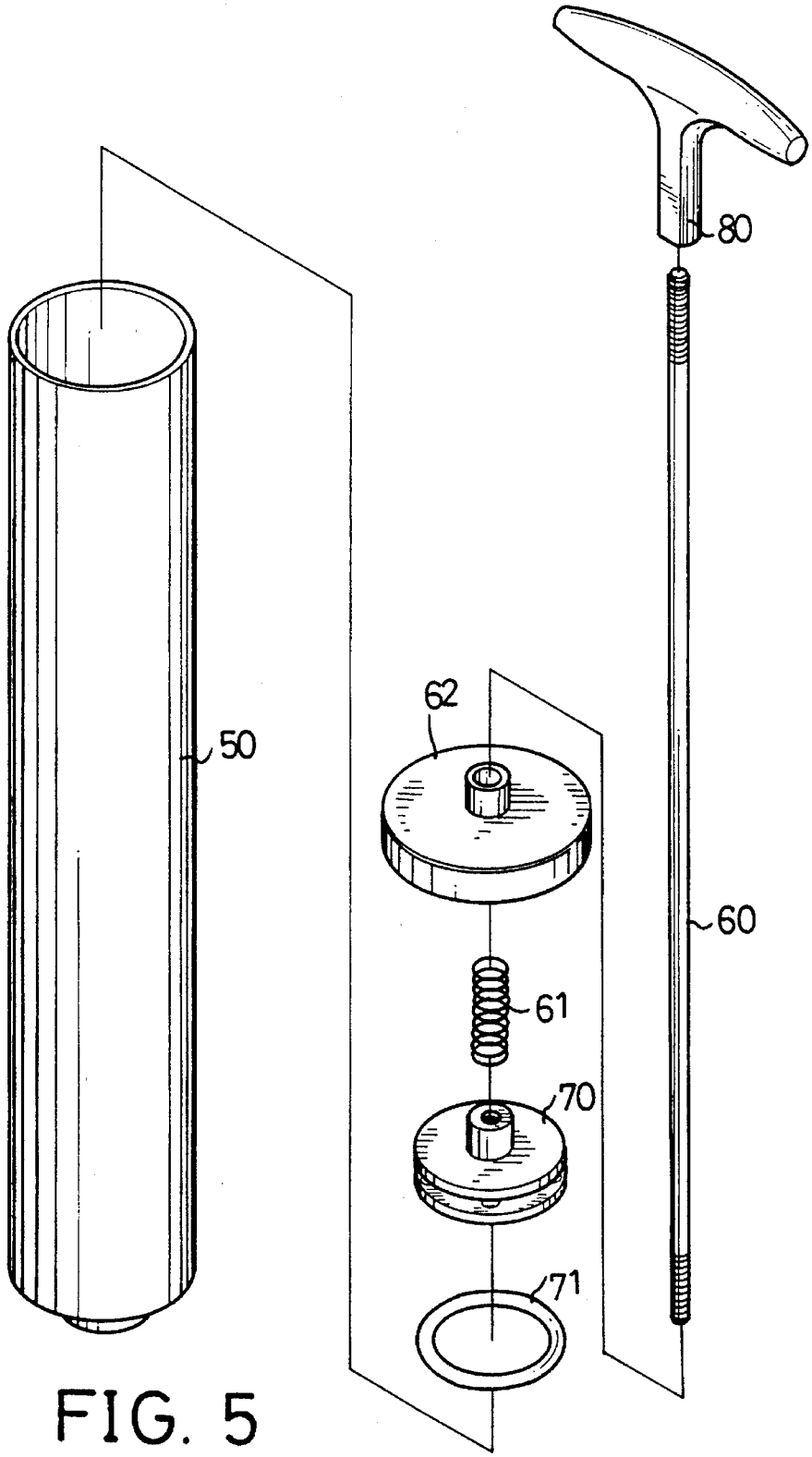
FIG. 5 PRIOR ART
FIG. 5 is an exploded view of a pump in accordance with prior art.

Referring to FIG. 5, a conventional type of manual pump has a cylinder 50. The cylinder 50 defines a nozzle through a first end thereof and an opening through a second end thereof. A piston 70 has a hub and first and second disks which are formed on the hub in a separated manner. A plurality of holes (not numbered) are defined through the first disk of the piston 70. A sealing ring 71 is mounted between the first and second disks of the piston 70. A limit 62 defines a hub. A stem 60 is inserted through the hub of the limit 62. The stem 60 is further inserted through a spring 61. Then, a first end of the stem 60 is attached in the hub of the piston 70. A second end of the stem 60 is attached to a T-shaped handle 80. The piston 70 is slidably received in the cylinder 50. The opening which is defined in the cylinder 50 is limited by means of the limit 60. Grease is provided on the piston 70.

As the handle 80 is pulled, the piston 70 is moved, by means of the stem 60, from the first end of the cylinder 50 toward the second end of the cylinder 50. The sealing ring 71 is thus pushed against the first disk of the piston 70. The grease provides a sealing effect between the cylinder 50 and the sealing ring 71 and a sealing effect between the sealing ring 71 and the first disk of the piston 70. However, a gap is defined between the cylinder 50 and the second disk of the piston 70. Thus, air is allowed to flow through the gap which is defined between the cylinder 50 and the second disk of the piston 70 and further through the holes which are defined through the first disk of the piston 70. As a result, air is drawn into the cylinder. In the above-mentioned stroke, the spring 61 acts a buffer between the piston 70 and the limit 62 as the former is moved toward the latter. The limit 62 will not be dislodged from the cylinder 50 when the piston 70 impacts against the limit 62 via the spring 61.

As the handle 80 is pushed, the piston 70 is moved, by means of the stem 60, from the second end of the cylinder 50 toward the first end of the cylinder 50. The sealing ring 71 is thus pushed against the second disk of the piston 70. The grease provides a sealing effect between the cylinder 50 and the sealing ring 71 and a sealing effect between the sealing ring 71 and the second disk of the piston 70. As air is kept from passing between the cylinder 50 and the sealing ring 71 and between the sealing ring 71 and the second disk of the piston 70, air is pushed out of the cylinder 50 through the nozzle which is defined through the cylinder 50.

A first drawback of the above-mentioned pump is that it is difficult to assemble such a pump. A second drawback of the above-mentioned pump is that the spring 61 will be fatigued easily so that it will not function as a buffer between the piston 70 and the limit 62. The above-mentioned drawbacks are obviated by a manual pump in accordance with the present invention which will be described.

DETAILED DESCRIPTION OF THE PREFERRED EMBODIMENT

Figure 1:
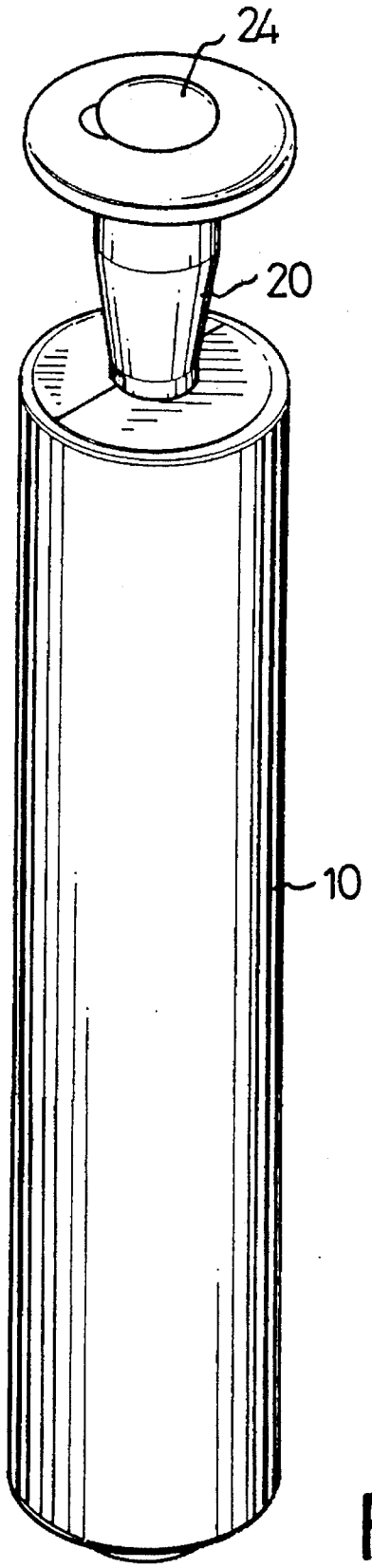
FIG. 1 is an isometric view of a pump in accordance with the preferred embodiment of the present invention.
Figure 2:
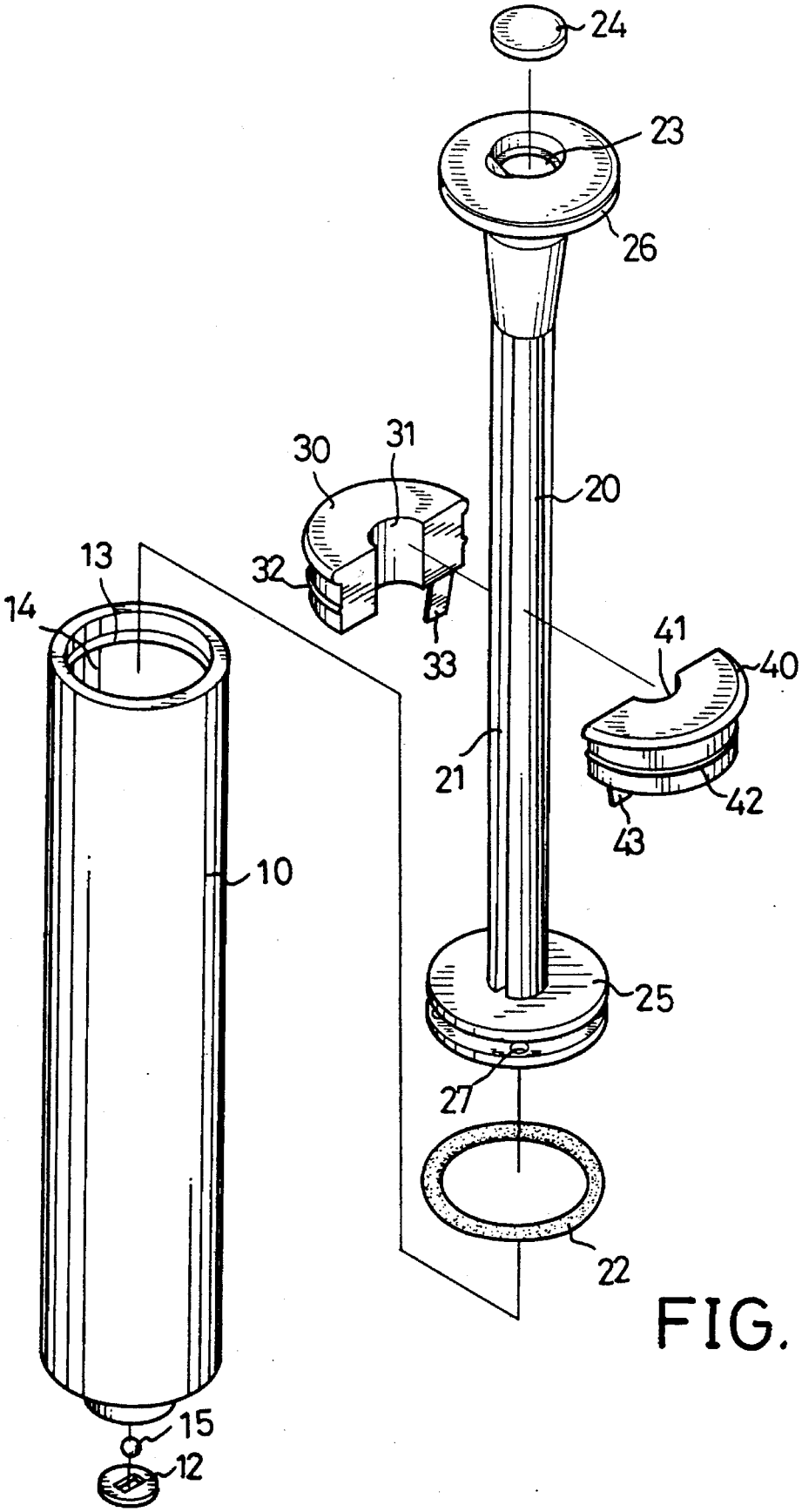
FIG. 2 is an exploded view of the pump shown in FIG. 1.

Referring to FIGS. 1 and 2, in accordance with the preferred embodiment of the present invention, a manual pump has a cylinder 10. The cylinder 10 has a first end defining a nozzle 11 (see FIG. 3) and a second end defining an opening 14. A ball 15 is received in the nozzle 11. A disk 12 defining a slot is received in the nozzle 11. The nozzle 11, the ball 15 and the disk 12 together form a check valve. The check valve so formed will not be further described as it is well known. A groove 13 is circumferentially defined in the internal surface of the cylinder 10.

A plunger has a stem 20 and a piston 25. The piston 25 is formed at a first end of the stem 20 while a knob 26 is formed at a second end of the stem 20. Two slots 21 are longitudinally defined in the stem 20. The piston 25 has first and second disks which are spaced from each other so that a sealing ring 22 can be mounted between them and that the sealing ring 22 can axially slide between them. A plurality of holes 27 (see FIG. 3) are defined through the first disk of the piston 25. A recess 23 is defined in the knob 26 to store a conventional adapter (not shown) which is generally used to connect the pump to a ball, however, the adapter will not be described in detail as it does not constitute a part of the present invention. The recess 23 can be closed by means of a cover 24.

Two halves 30 and 40 can be assembled into an annular limit. A semi-circular cutout 31 is defined in the half 30 and a semi-circular cutout 41 is defined in the half 40, so that the semi-circular cutouts 31 and 41 together define a hole as the halves 30 and 40 are combined. A semi-annular flange 32 is formed on the half 30 while a semi-annular flange 42 is formed on the half 40, so that the semi-annular flanges 32 and 42 together form an annular flange as the halves 30 and 40 are combined. A tab 33 projects from the underside of the half 30 while a tab 43 projects from the underside of the half 40.

The stem 20 is disposed between the halves 30 and 40 so that the stem 20 is slidable in the hole which is defined by means of the semi-circular cutouts 31 and 41 as the halves 30 and 40 are joined together. The annular flange which is formed by means of the semi-annular flanges 32 and 42 is received in the groove 13, so that the limit which is formed by means of the halves 30 and 40 is attached to the cylinder 10. The piston 25 is thus retained in the cylinder 10. As there is only a small gap between the stem 20 and the limit which is formed by means of the halves 30 and 40, the slots 21 allow air to flow into the cylinder 10 easily. Grease is provided on the piston 25.

Figure 3:
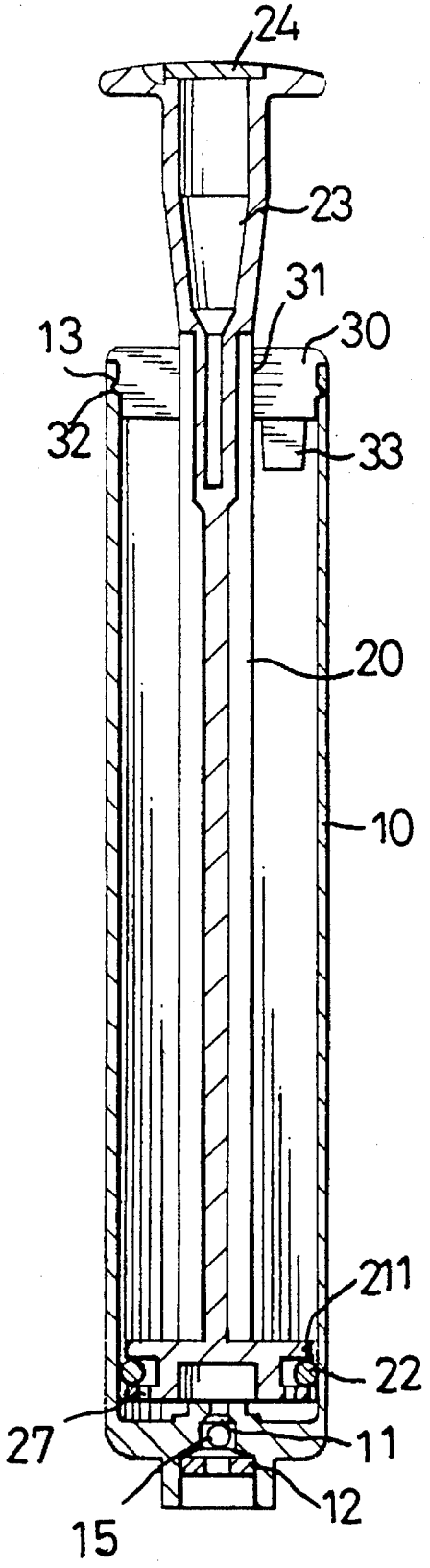
FIG. 3 is a vertical cross-sectional view of the pump shown in FIG. 1, showing a piston in a first position in a cylinder.
Figure 4:
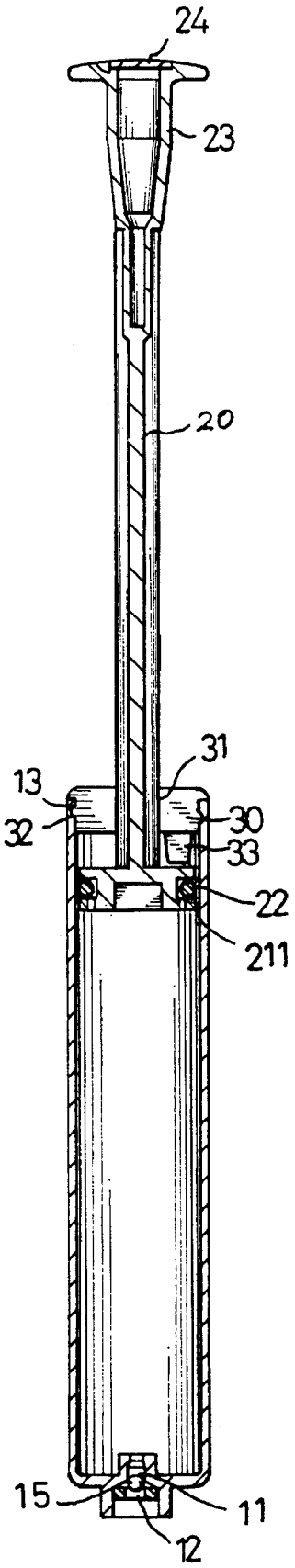
FIG. 4 is vertical cross-sectional view similar to FIG. 3, but showing the piston in a second position in the cylinder.

Referring to FIG. 3, the piston 25 is at a first position in the cylinder 10. Referring to FIG. 4, the piston is at a second position in the cylinder 10. In an intake stroke, the piston 25 is moved from the first position to the second position. In an output stroke, the piston 25 is moved from the second position to the first position.

As the knob 26 is pulled, the piston 25 is moved, by means of the stem 20, from the first end of the cylinder 10 toward the second end of the cylinder 10. The sealing ring 22 is thus pushed against the first disk of the piston 25. The grease provides a sealing effect between the cylinder 10 and the sealing ring 22 and a sealing effect between the sealing ring 22 and the first disk of the piston 25. However, a gap is defined between the cylinder 10 and the second disk of the piston 25. Thus, air is allowed to flow through the gap which is defined between the cylinder 10 and the second disk of the piston 25 and further through the holes 27. As a result, air is drawn into the cylinder. The tabs 33 and 43 function as buffers between the piston 25 and the annular limit which is formed by means of the halves 30 and 40. Obviously, the tabs 33 and 43 replace the spring 61 of the above-mentioned conventional pump.

As the knob 26 is pushed, the piston 25 is moved, by means of the stem 20, from the second end of the cylinder 10 toward the first end of the cylinder 10. The sealing ring 22 is thus pushed against the second disk of the piston 25. The grease provides a sealing effect between the cylinder 10 and the sealing ring 22 and a sealing effect between the sealing ring 22 and the second disk of the piston 25. As air is kept from passing between the cylinder 10 and the sealing ring 22 and between the sealing ring 22 and the second disk of the piston 25, air is pushed out of the cylinder 10 through the nozzle which is defined through the cylinder 10.

It is easy to assemble the manual pump of the present invention as a piston is integrally joined together with a stem so as to form a plunger. The need for a metal spring as a buffer is eliminated as two tabs are used.

While the present invention has been explained in relation to its preferred embodiment, it is to be understood that variations thereof will be apparent to those skilled in the art upon reading this specification. Therefore, the present invention is intended to limit all such variations as shall fall within the scope of the appended claims.

I claim:

1. A manual pump comprising:

a cylinder defining a nozzle through a first end, an opening through a second end and a groove circumferentially in an internal surface thereof near the opening;

a check valve in communication with the nozzle a plunger comprising a stem and a piston formed at an end of the stem, the stem comprising at least a slot longitudinally defined therein, the piston comprising first and second disks spaced from each other and a plurality of holes defined through the first disk thereof;

a sealing ring being mounted between the first and second disks of the piston;

a knob being formed at an opposite end of the stem; and an annular limit comprising two semi-annular halves between which the stem is inserted, each semi-annular half comprising a semi-annular flange formed thereon in order to be engaged in the groove defined in the cylinder so that the annular limit is attached in the cylinder so as to retain the piston in the cylinder.

2. A manual pump in accordance with claim 1 wherein each semi-annular half of the annular limit comprises a tab projecting from the underside thereof.

3. A manual pump in accordance with claim 1 wherein the check value includes a ball secured in the nozzle and a slotted disk received in the nozzle.

4. A manual pump in accordance with claim 1 comprising a recess defined in the knob and a cover for sealing the recess.

* * * * *